US012232537B2

(12) United States Patent
Cho et al.

(10) Patent No.: US 12,232,537 B2
(45) Date of Patent: Feb. 25, 2025

(54) AEROSOL GENERATING DEVICE

(71) Applicant: KT&G CORPORATION, Daejeon (KR)

(72) Inventors: Byung Sung Cho, Gyeonggi-do (KR); Won Kyeong Lee, Gyeonggi-do (KR); Min Kyu Kim, Daejeon (KR); Jong Sub Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 900 days.

(21) Appl. No.: 17/293,242

(22) PCT Filed: Dec. 14, 2020

(86) PCT No.: PCT/KR2020/018258
§ 371 (c)(1),
(2) Date: May 12, 2021

(87) PCT Pub. No.: WO2021/145570
PCT Pub. Date: Jul. 22, 2021

(65) Prior Publication Data

US 2022/0361580 A1 Nov. 17, 2022

(30) Foreign Application Priority Data

Jan. 16, 2020 (KR) ..... 10-2020-0006165

(51) Int. Cl.
*A24F 40/50* (2020.01)
*A24F 40/10* (2020.01)
*A24F 40/40* (2020.01)

(52) U.S. Cl.
CPC ..... *A24F 40/50* (2020.01); *A24F 40/10* (2020.01); *A24F 40/40* (2020.01)

(58) Field of Classification Search
None
See application file for complete search history.

(56) References Cited

U.S. PATENT DOCUMENTS 10,757,977 B2 9/2020 Qiu
2014/0157583 A1* 6/2014 Ward ..... A24F 40/70 29/729

(Continued)

FOREIGN PATENT DOCUMENTS

CN 105163610 A 12/2015
CN 107536111 A 1/2018

(Continued)

OTHER PUBLICATIONS

Machine translation of WO-2019082280-A1 (Year: 2024).*

(Continued)

*Primary Examiner* — Geoffrey S Evans
(74) *Attorney, Agent, or Firm* — Sughrue Mion, PLLC

(57) ABSTRACT

An aerosol generating device and a controlling method thereof are provided. An aerosol generating device includes: a battery configured to supply power for generating an aerosol from an aerosol generating material; a converter configured to convert a supply voltage from the battery into a constant voltage of a predetermined level; a heater configured to heat the aerosol generating material using the supply voltage; a detection circuit configured to detect a change in resistance of the heater by applying the constant voltage output from the converter and performing a current sensing on the heater with a resistance value; and a controller configured to control the heater for generating the aerosol by switching between a monitoring mode for performing the detection of the change in the resistance of the heater using the constant voltage and a heating mode for heating the heater using the supply voltage.

8 Claims, 12 Drawing Sheets

(56) References Cited

U.S. PATENT DOCUMENTS

| | | | | |
|---|---|---|---|---|
| 2014/0321837 | A1* | 10/2014 | Flick | A61M 15/06 392/394 |
| 2016/0150825 | A1 | 6/2016 | Mironov et al. | |
| 2018/0289070 | A1 | 10/2018 | Qiu | |
| 2018/0306863 | A1 | 10/2018 | Novak, III et al. | |
| 2018/0310616 | A1* | 11/2018 | Clemens | H05B 3/42 |
| 2019/0104770 | A1 | 4/2019 | Ding | |
| 2019/0212389 | A1 | 7/2019 | Novak, III et al. | |
| 2020/0046033 | A1 | 2/2020 | Robert et al. | |
| 2020/0107582 | A1 | 4/2020 | Mizuguchi et al. | |
| 2020/0154787 | A1* | 5/2020 | Novak, III | H03K 7/08 |
| 2020/0237012 | A1 | 7/2020 | Yamada et al. | |
| 2020/0245687 | A1 | 8/2020 | Tsuji et al. | |
| 2020/0281277 | A1 | 9/2020 | Akao et al. | |
| 2020/0288783 | A1 | 9/2020 | Sur et al. | |
| 2021/0084985 | A1 | 3/2021 | Akao et al. | |

FOREIGN PATENT DOCUMENTS

| | | | |
|---|---|---|---|
| CN | 108402527 | A | 8/2018 |
| CN | 108873976 | A | 11/2018 |
| JP | 2949114 | B1 | 9/1999 |
| JP | 11248661 | A | 9/1999 |
| JP | 2016-513453 | A | 5/2016 |
| JP | 6561188 | B1 | 8/2019 |
| JP | 6588669 | B1 | 10/2019 |
| KR | 10-2017-0107518 | A | 9/2017 |
| KR | 10-2019-0077566 | A | 7/2019 |
| KR | 10-2019-0140455 | A | 12/2019 |
| WO | 2019/077708 | A1 | 4/2019 |
| WO | 2019/082262 | A1 | 5/2019 |
| WO | 2019/082281 | A1 | 5/2019 |
| WO | WO-2019082280 | A1 * | 5/2019 ..... A24F 40/50 |
| WO | 2019/239548 | A1 | 12/2019 |
| WO | WO-2020000152 | A1 * | 1/2020 ..... G05D 23/1917 |
| WO | 2020/208866 | A1 | 10/2020 |
| WO | WO-2021105379 | A1 * | 6/2021 ..... A24F 40/46 |

OTHER PUBLICATIONS

Machine translation WO-2020000152A1, Jul. 2024 (Year: 2024).*
Office Action dated Apr. 28, 2023 from the Chinese Patent Office in Application No. 202080007673.3.
Notification of Reasons for Refusal dated Feb. 28, 2023 from the Japanese Patent Office in application No. 2021-538338.
Communication dated Sep. 22, 2023 issued by the State Intellectual Property Office of the P.R.China in application No. 202080007673.3.
Korean Office Action for 10-2020-0006165 dated Apr. 28, 2021.
Office Action dated Aug. 2, 2022 issued by the Japanese Patent Office in Japanese Application No. 2021-538338.
International Search Report dated May 7, 2021 in Application No. PCT/KR2020/018258.
Extended European Search Report issued Nov. 19, 2021 in European Application No. 20883279.0.

* cited by examiner

AEROSOL GENERATING DEVICE

TECHNICAL FIELD

The disclosure relates to an aerosol generating device, and more particularly, to an aerosol generating device in which battery efficiency is improved by classifying an operation mode using a constant voltage and an operation mode not using a constant voltage.

BACKGROUND ART

Recently, the demand for alternative methods overcoming the shortcomings of general cigarettes has increased. For example, there is an increasing demand for a method of generating aerosols by heating an aerosol generating material in cigarettes, rather than by combusting cigarettes. Accordingly, studies on a heating-type cigarette or a heating-type aerosol generating device have been actively conducted.

A supply voltage of a battery may be used to drive each of hardware/software components of an aerosol generating device. However, a supply voltage of the battery provided to each of the components may cause a voltage fluctuation phenomenon according to various factors such as a battery charge capacity and a use environment of the aerosol generating device (e.g., ambient temperature, humidity, or the like). When a precise measurement is needed such as a detection of resistance of a heater, an accurate resistance value may not be detected due to such an irregular voltage fluctuation, and thus, heating control of the heater may not be performed precisely. Therefore, there is a need for a method of increasing efficiency of a battery of an aerosol generating device while precisely performing heating control of a heater.

DISCLOSURE OF INVENTION

Technical Problem

One or more embodiments include an aerosol generating device in which battery efficiency is improved by classifying an operation mode using a constant voltage and an operation mode not using a constant voltage. The technical problems to be solved by one or more embodiments are not limited to the technical problems as described above, and other technical problems may be solved from the one or more embodiments.

Solution to Problem

According to one or more embodiments, an aerosol generating device includes: a battery configured to supply power for generating an aerosol from an aerosol generating material; a converter configured to convert a supply voltage from the battery to a constant voltage; a heater configured to heat the aerosol generating material by using the supply voltage from the battery; a detection circuit configured to detect a change in resistance of the heater by obtaining a resistance value of the heater based on a current flowing through the heater using the constant voltage output from the converter; and a controller configured to control the heater to generate the aerosol by switching of a monitoring mode for performing the detection of the change in resistance by the constant voltage and a heating mode for heating the heater by the supply voltage.

Advantageous Effects of Invention

According to one or more embodiments, in an aerosol generating device, a constant voltage may be controlled to be applied for an operation that needs precise and accurate control, and instead of applying a constant voltage, a supply voltage of a battery may be applied for an operation that does not require precise and accurate control, thereby improving battery efficiency.

BEST MODE FOR CARRYING OUT THE INVENTION

Figure 1:
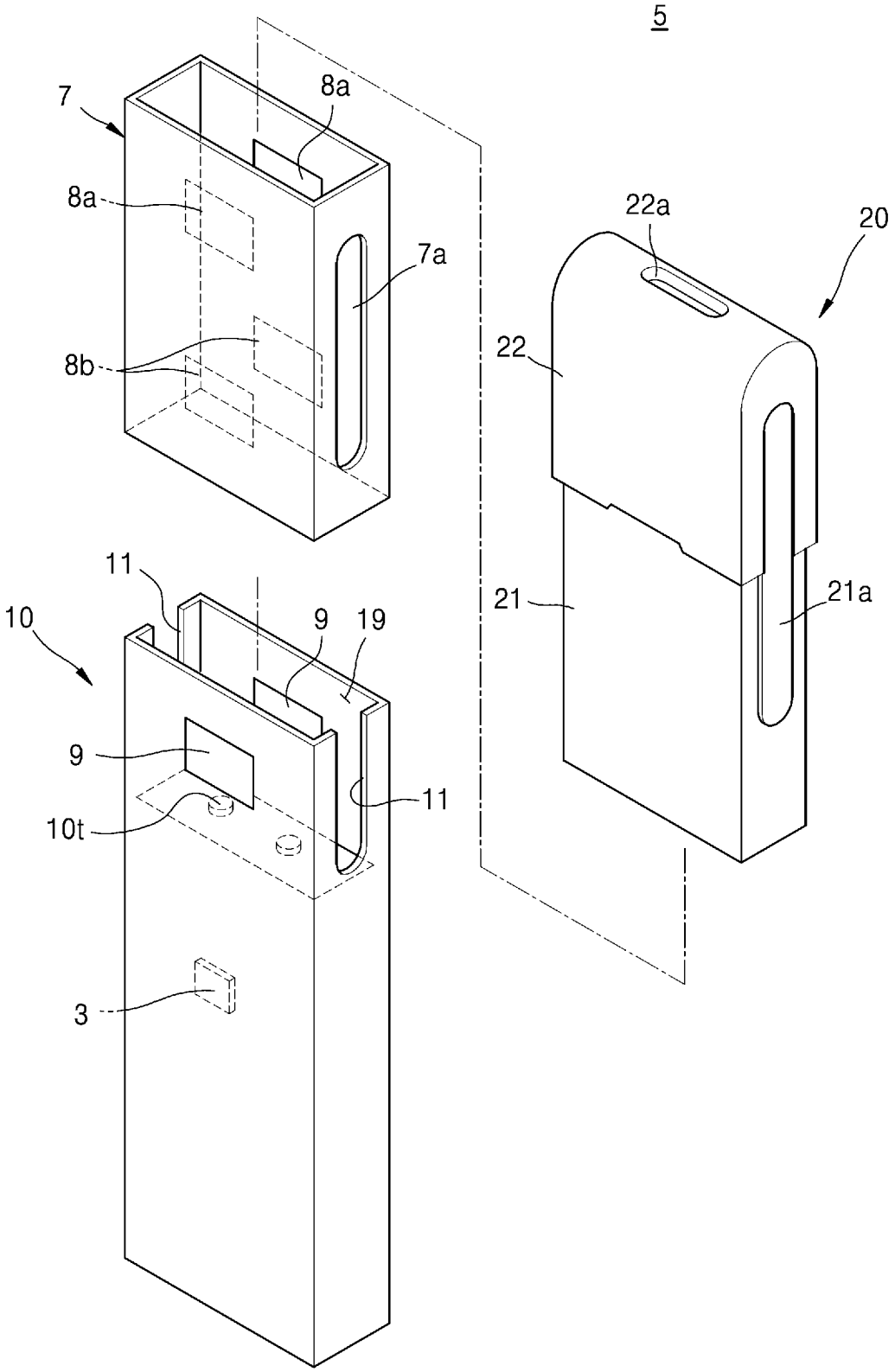
FIG. 1 is an exploded perspective view schematically illustrating a coupling relationship between a replaceable cartridge including an aerosol generating material and an aerosol generating device including the same, according to an exemplary embodiment.

According to an aspect of the disclosure, an aerosol generating device includes: a battery configured to supply power for generating an aerosol from an aerosol generating material; a converter configured to convert a supply voltage from the battery into a constant voltage of a predetermined level; a heater configured to heat the aerosol generating material using the supply voltage; a detection circuit configured to detect a change in resistance of the heater by applying the constant voltage output from the converter and performing a current sensing on the heater with a resistance value; and a controller configured to control the heater for generating the aerosol by switching between a monitoring mode for performing the detection of the change in the resistance of the heater using the constant voltage and a heating mode for heating the heater using the supply voltage.

The controller is further configured to perform a pulse width modulation (PWM) control on the supply voltage to be supplied to the heater for the heating mode by performing a feedback of monitoring using the detected change in the resistance by applying the constant voltage in the monitoring mode.

The controller is further configured to perform the PWM control so that the aerosol generating material is heated to a target temperature range through the feedback from the monitoring mode.

Based on the change in the resistance of the heater detected in the monitoring mode, the controller is configured to determine a duty ratio or a duty cycle for the PWM control for the heating mode.

The controller is further configured to: perform the PWM control so that the duty ratio or the duty cycle decreases in the heating mode based on the resistance value of the heater being greater than a predetermined resistance value in the monitoring mode, and perform the PWM control so that the duty ratio or the duty cycle increases in the heating mode based on the resistance value of the heater being less than the predetermined resistance value in the monitoring mode.

The controller is further configured to control the switching so that the monitoring mode and the heating mode are performed alternately and repeatedly.

The aerosol generating device further includes: a switching circuit configured to perform the switching so that one of the constant voltage and the supply voltage is selectively supplied to the heater, and the controller is further configured to control the switching circuit to selectively perform one of the monitoring mode and the heating mode.

The constant voltage of the predetermined level is 3.3V.

The aerosol generating device further includes: a cartridge having a liquid reservoir including the aerosol generating material in a liquid state, and the cartridge includes: a wick through which the aerosol generating material is transferred; and the heater wound around the wick.

According to an aspect of the disclosure, there is provided a method of controlling an aerosol generating device. The method includes: converting a supply voltage from a battery into a constant voltage of a predetermined level; detecting a change in resistance of a heater by applying the constant voltage and performing a current sensing on the heater with a resistance value; controlling a switching between the monitoring mode to a heating mode; and based on switching to the heating mode, supplying the supply voltage of the battery to the heater for generating an aerosol from an aerosol generating material.

The controlling the heater includes performing a pulse width modulation (PWM) control on the supply voltage to be supplied to the heater for the heating mode by performing a feedback of monitoring according to the detected change in the resistance by applying the constant voltage in the monitoring mode.

The controlling of the heater includes: based on the change in the resistance of the heater detected in the monitoring mode, determining a duty ratio or a duty cycle for PWM control for the heating mode; and controlling the heater by performing the PWM control based on the determined duty ratio or duty cycle.

The determining of the duty ratio or the duty cycle includes: based on the resistance value of the heater being greater than a predetermined resistance value in the monitoring mode, determining the duty ratio or the duty cycle to decrease in the heating mode; and based on the resistance value of the heater being less than the predetermined resistance value in the monitoring mode, determining the duty ratio or the duty cycle to increase in the heating mode.

The method further includes: based on the controlling of the heater being performed during a predetermined period, controlling the switching from the heating mode to the monitoring mode, and the monitoring mode and the heating mode are switched to be performed alternately and repeatedly.

Mode for the Invention

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "connected to" or "coupled to" another element, it can be directly over, above, on, connected or coupled to the other element or intervening elements may be present. In contrast, when an element is referred to as being "directly over," "directly above," "directly on," "directly connected to" or "directly coupled to" another element, there are no intervening elements present.

With respect to the terms used to describe the various embodiments, general terms which are currently and widely used are selected in consideration of functions of structural elements in the various embodiments of the present disclosure. However, meanings of the terms can be changed according to the intention of one of ordinary skill in the art, a judicial precedents, an emergence of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and in the context of the descriptions provided herein.

In addition, unless explicitly indicated otherwise, the term "comprise" and variations such as "comprises" or "comprising" will be understood to imply the inclusion of stated elements but not the exclusion of any other elements. In addition, the terms "-er", "-or", and "module" may refer to units for processing at least one function and/or operation and can be implemented by hardware components or software components and combinations thereof.

Hereinafter, the present disclosure will now be described in more detail with reference to the accompanying drawings, in which exemplary embodiments of the present disclosure are shown such that one of ordinary skill in the art may easily understand and practice the present disclosure. The disclosure may, however, be embodied in many different forms and should not be construed as being limited to the embodiments set forth herein.

FIG. 1 is an exploded perspective view schematically illustrating a coupling relationship between a replaceable cartridge including an aerosol generating material and an aerosol generating device including the same, according to an exemplary embodiment.

An aerosol generating device 5 according to an embodiment illustrated in FIG. 1 includes the cartridge 20 including the aerosol generating material and a main body 10 supporting the cartridge 20.

The cartridge 20 may be coupled to the main body 10 in a state in which the aerosol generating material is accommodated therein. A portion of the cartridge 20 is inserted into an accommodation space 19 of the main body 10 so that the cartridge 20 may be inserted into the main body 10.

The cartridge 20 may include an aerosol generating material in any one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group including benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating aerosol by converting a state or phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material by receiving the electrical signal from the main body 10 and heating the aerosol generating material, by using an ultrasonic vibration method, or by using an induction heating method. As another example, when the cartridge 20 includes its own power source, the cartridge 20 may generate aerosol by operating according to an electric control signal or a wireless signal transmitted from the main body 10.

The cartridge 20 may include a liquid storage 21 for storing the aerosol generating material therein, and an atomizer configured to convert the aerosol generating material in the liquid storage 21 to aerosol.

When the liquid storage 21 "accommodates or stores the aerosol generating material" therein, it may mean that the liquid storage 21 functions as a container holding an aerosol generating material and that the liquid storage 21 includes therein an element impregnated with (or containing) an aerosol generating material, such as a sponge, cotton, fabric, or porous ceramic structure.

The atomizer may include, for example, a liquid delivery element (wick) for absorbing the aerosol generating material and maintaining the absorbed aerosol generating material in an optimal state for conversion to aerosol, and a heater configured to heat the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like, to heat the aerosol generating material delivered to the liquid delivery element by generating heat using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which performs both the functions of absorbing the aerosol generating material and maintaining the absorbed aerosol generating material in an optimal state for conversion to aerosol without using a separate liquid delivery element and the function of generating aerosol by heating the aerosol generating material.

At least a portion of the liquid storage 21 of the cartridge 20 may include a transparent material so that the aerosol generating material in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and the liquid storage 21 may be entirely formed of transparent plastic or glass, and/or only the protruding window 21*a* on a portion of the liquid storage 21 may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to an operation of the cartridge 20 to the cartridge 20.

The mouthpiece 22 may be coupled to one end of the liquid storage 21 of the cartridge 20. The mouthpiece 22 may be a portion of the aerosol generating device 5, which may be in contact with a user's mouth. The mouthpiece 22 includes a discharge hole 22*a* for discharging aerosol generated from the aerosol generating material inside the liquid storage 21 to the outside.

The slider 7 is coupled to the main body 10 to move with respect to the main body 10. The slider 7 covers at least a portion of the mouthpiece 22 of the cartridge 20 coupled to the main body 10 or exposes at least a portion of the mouthpiece 22 to the outside by moving with respect to the main body 10. The slider 7 includes an elongated hole 7*a* exposing at least a portion of the protruding window 21*a* of the cartridge 20 to the outside.

The slider 7 may be in the form of a container shape with a hollow space therein and both ends opened. The structure of the slider 7 is not limited to the container shape as shown in the drawing, and the slider 7 may have a bent plate structure having a clip-shaped cross-section, which is movable with respect to the main body 10 while being coupled to an edge of the main body 10, or a structure having a curved semi-cylindrical shape and a curved arc-shaped cross section.

The slider 7 includes a magnetic body for maintaining the position of the slider 7 with respect to the main body 10 and the cartridge 20. The magnetic body may include a permanent magnet or a material such as iron, nickel, cobalt, or an alloy thereof.

The magnetic body includes two first magnetic bodies 8*a* facing each other with an inner space of the slider 7 therebetween, and two second magnetic bodies 8*b* facing each other with the inner space of the slider 7 therebetween. The first magnetic bodies 8*a* and the second magnetic bodies 8*b* are arranged to be spaced apart from each other along a longitudinal direction of the main body 10, which is a moving direction of the slider 7, that is, the direction in which the main body 10 extends.

The main body 10 includes a fixed magnetic body 9 arranged on a path along which the first magnetic bodies 8*a* and the second magnetic bodies 8*b* of the slider 7 move while the slider 7 moves with respect to the main body 10. Two fixed magnetic bodies 9 of the main body 10 may be disposed to face each other with the accommodation space 19 therebetween.

Depending on the position of the slider 7, the slider 7 may be stably maintained in a position where one end of the mouthpiece 22 is covered or exposed to a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move while the slider 7 moves with respect to the main body 10. The position change detecting sensor 3 may include, for example, a Hall IC using the Hall effect that detects a change in a magnetic field and generates a signal.

In the aerosol generating device 5 according to the above-described embodiments, the main body 10, the cartridge 20, and the slider 7 have approximately rectangular cross-sectional shapes in a direction transverse to the longitudinal direction, but in one or more embodiments, the shape of the aerosol generating device 5 is not limited thereto. The aerosol generating device 5 may have, for example, a cross-sectional area in a shape of a circle, an ellipse, a square, or various polygonal shapes. In addition, the aerosol generating device 5 is not necessarily limited to a structure that extends linearly when extending in the longitudinal direction, and may extend a long way while being curved in a streamlined shape or bent at a preset angle in a specific area to be easily held by the user.

Figure 2:
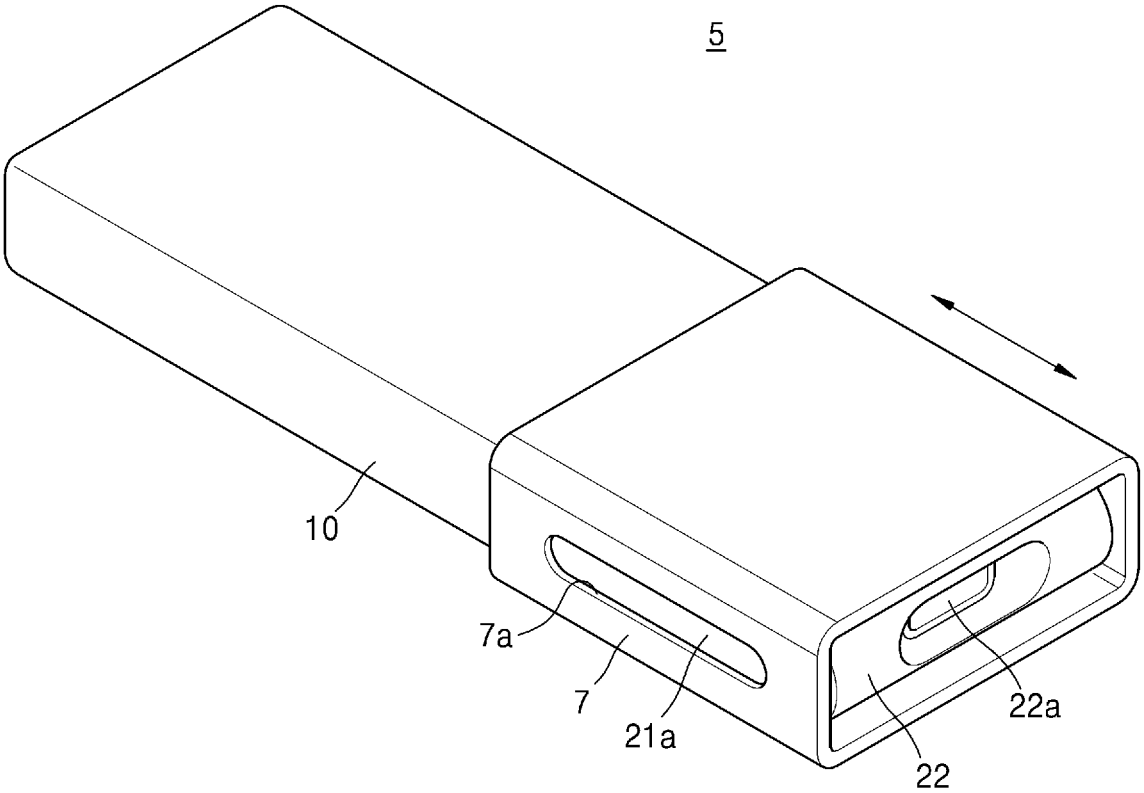
FIG. 2 is a perspective view of an operating state of the aerosol generating device of FIG. 1 according to an exemplary embodiment.

FIG. 2 is a perspective view of an operating state of the aerosol generating device of FIG. 1 according to an exemplary embodiment.

In FIG. 2, the operating state is shown in which the slider 7 is moved to a position where the end of the mouthpiece 22 of the cartridge 20 coupled to the main body 10 is covered. In a state where the slider 7 is moved to the position where the end of the mouthpiece 22 is covered, the mouthpiece 22 may be safely protected from external impurities and kept clean.

The user may check the remaining amount of aerosol generating material contained in the cartridge 20 by visually checking the protruding window 21*a* of the cartridge 20 through the elongated hole 7*a* of the slider 7. The user may move the slider 7 in the longitudinal direction of the main body 10 to use the aerosol generating device 5.

Figure 3:
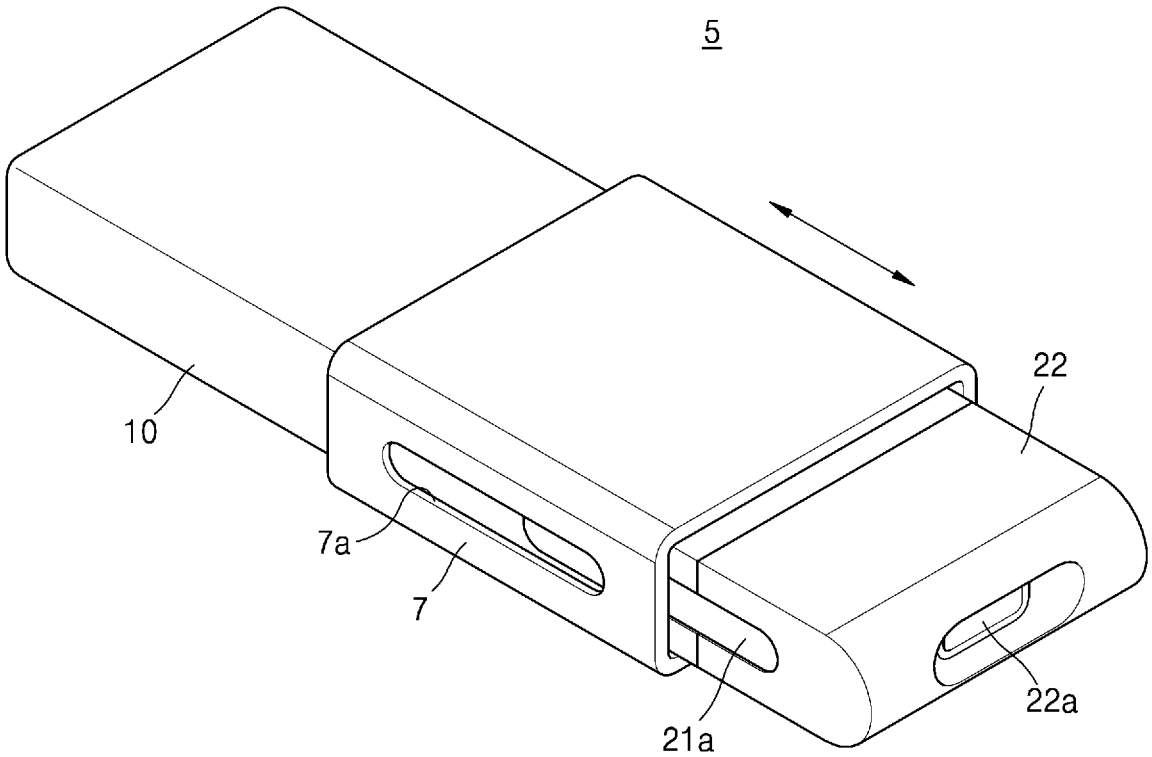
FIG. 3 is a perspective view of an operating state of the aerosol generating device of FIG. 1 according to another exemplary embodiment.

FIG. 3 is a perspective view of an operating state of the aerosol generating device of FIG. 1 according to another exemplary embodiment.

In FIG. 3, the operating state is shown in which the slider 7 is moved to a position where the end of the mouthpiece 22 of the cartridge 20 coupled to the main body 10 is exposed to the outside. In a state where the slider 7 is moved to the position where the end of the mouthpiece 22 is exposed to the outside, the user may insert the mouthpiece 22 into his or her mouth and absorb aerosol discharged through the discharge hole 22*a* of the mouthpiece 22.

Even when the slider 7 is moved to the position where the end of the mouthpiece 22 is exposed to the outside, the protruding window 21*a* of the cartridge 20 may be exposed to the outside through the elongated hole 7*a* of the slider 7, and thus, the user may visually check the remaining amount of a liquid aerosol generating material contained in the cartridge 20.

Figure 4:
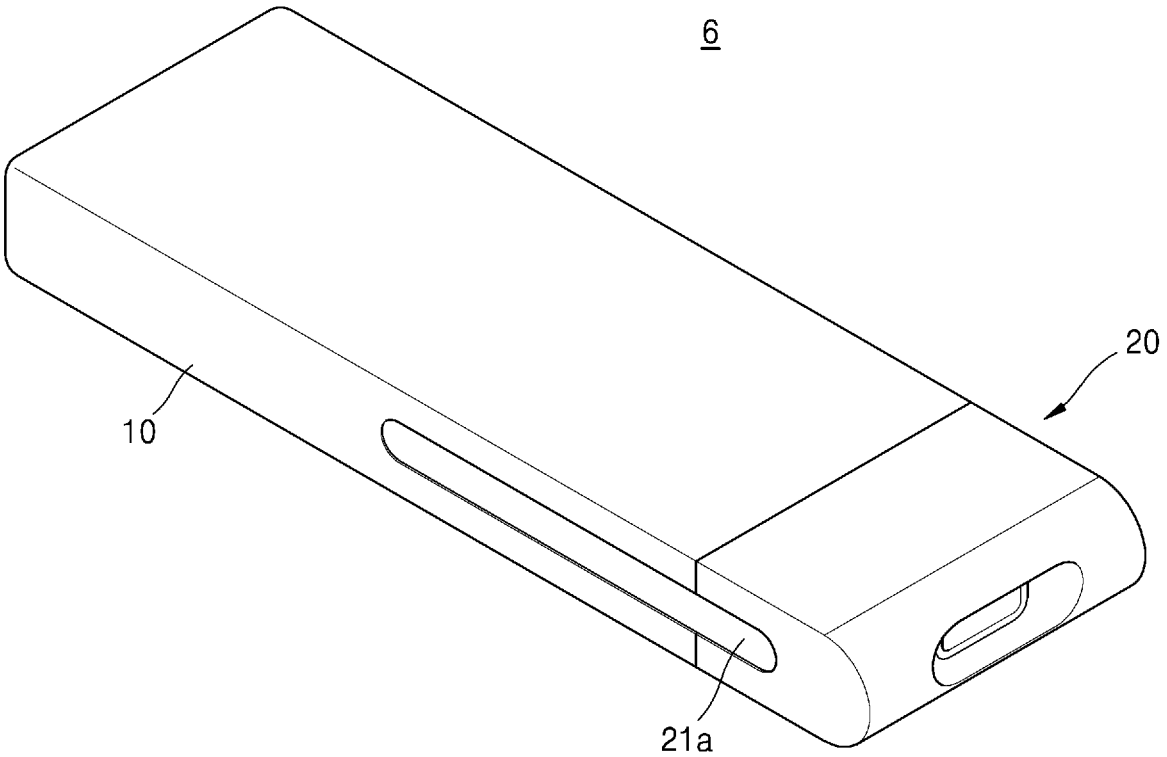
FIG. 4 is a view illustrating an aerosol generating device having a cartridge, according to an exemplary embodiment.

FIG. 4 is a view illustrating an aerosol generating device having a cartridge according to an exemplary embodiment.

Referring to FIG. 4, unlike the aerosol generating device 5 described above with reference to FIGS. 1 through 3, an aerosol generating device 6 is a type in which the slider 7 is not provided. Therefore, the aerosol generating device 6 may be implemented by coupling only a cartridge 20 to a main body 10 as described above. The coupling between the cartridge 20 and the main body 10 may include inserting a protruding window 21*a* of the cartridge 20 into the main body 10.

Since the aerosol generating device 6 is not provided with the slider 7, the aerosol generating device 6 may not include components associated with the fixed magnetic body 9 and the Hall IC, such as the position change detecting sensor 3 described above with reference to FIGS. 1 through 3. However, the aerosol generating device 6 may equally include components other than the components associated with the Hall IC.

The aerosol generating device 6 may turn on/off the power of the aerosol generating device 6 by using a puff sensor. The puff sensor may detect an air flow inside the aerosol generating device 6. When the puff sensor detects that an air flow exceeds a threshold value, it may be determined that the user is puffing, and thus, the aerosol generating device 6 may be turned on. The puff sensor may be preset to detect only an air flow in a particular direction, but the embodiment is not limited thereto.

In other words, instead of controlling the power to turn on/off by using the slider 7 in the aerosol generating device 5 described in the embodiments of FIGS. 1 through 3, the aerosol generating device 6 may start operation of the aerosol generating device 6 as a result of detection by the puff sensor due to the user's act of inhalation. Therefore, the operation of the aerosol generating device 6 may start without a separate user input signal (e.g., pressing a power button). The start of the operation of the aerosol generating device 6 may indicate that power is supplied from a battery to a heater.

An aerosol generating device described below may be any one of aerosol generating device (5 or 6) in the embodiments described with reference to FIGS. 1 through 4.

Figure 5:
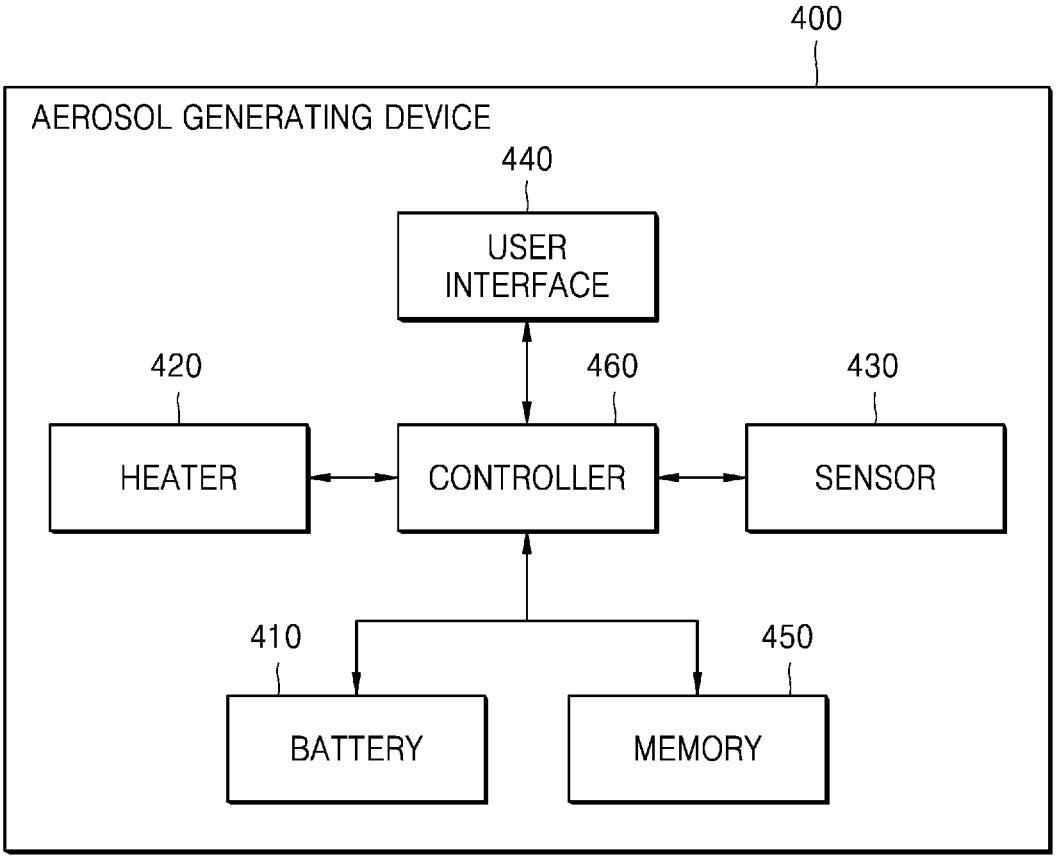
FIG. 5 is a block diagram illustrating hardware components of an aerosol generating device according to an exemplary embodiment.

FIG. 5 is a block diagram illustrating hardware components of an aerosol generating device according to an exemplary embodiment.

Referring to FIG. 5, the aerosol generating device 400 may include a battery 410, a heater 420, a sensor 430, a user interface 440, a memory 450, and a controller 460. However, the internal structure of the aerosol generating device 400 is not limited to the structures illustrated in FIG. 5. According to the design of the aerosol generating device 400, it will be understood by one of ordinary skill in the art that some of the hardware components shown in FIG. 5 may be omitted or additional components may be included.

The aerosol generating device 400 of FIG. 5 may correspond to the aerosol generating device 5 described with reference to FIGS. 1 through 3 or may correspond to the aerosol generating device 6 described with reference to FIG. 4 but is not limited thereto, and may be a device having a different structure.

In an embodiment, the aerosol generating device 400 may be only include a main body, in which case hardware components included in the aerosol generating device 400 are located in the main body. In another embodiment, the aerosol generating device 400 may be made of a main body and a cartridge, and hardware components included in the aerosol generating device 400 may be divided and located in the main body and the cartridge. Also, at least some of the hardware components included in the aerosol generating device 400 may be located in the main body and the cartridge, respectively.

Hereinafter, an operation of each of the components will be described without limiting the location of each of the components in a particular space in the aerosol generating device 400.

The battery 410 may supply electric power to operate the aerosol generating device 400. For example, the battery 410 may supply power such that the heater 420 may be heated. In addition, the battery 410 may supply power required for operations of other hardware components included in the aerosol generating device 400, such as, the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 may receive power from the battery 410 under the control of the controller 460. The heater 420 may receive power from the battery 410 and heat a cigarette inserted into the aerosol generating device 400, or heat the cartridge inserted into the aerosol generating device 400.

The heater 420 may be located in the main body of the aerosol generating device 400. Alternatively, when the aerosol generating device 400 includes the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, a coil, but is not limited thereto.

In an embodiment, the heater 420 may be a component included in the cartridge. The cartridge may include the heater 420, the liquid delivery element, and the liquid storage. The aerosol generating material accommodated in the liquid storage may be delivered to the liquid delivery element, and the heater 420 may heat the aerosol generating material absorbed by the liquid delivery element, thereby generating aerosol. For example, the heater 420 may include a material such as nickel or chromium, and may be wound around or arranged adjacent to the liquid delivery element.

In another embodiment, the heater 420 may heat the cigarette inserted into the accommodation space of the aerosol generating device 400. As the cigarette is inserted into the accommodation space of the aerosol generating device 400, the heater 420 may be located inside and/or outside the cigarette. Accordingly, the heater 420 may generate aerosol by heating the aerosol generating material in the cigarette.

In addition, the heater 420 may include an induction heater. The heater 420 may include an electrically conductive coil for heating a cigarette or the cartridge in an induction heating method, and the cigarette or the cartridge may include a susceptor which may be heated by the induction heater.

The aerosol generating device 400 may include at least one sensor 430. A sensed result obtained by the at least one sensor 430 may be transmitted to the controller 460, and the controller 460 may control the aerosol generating device 400 according to the sensing result to perform various functions, such as controlling operation of the heater 420 (e.g., controlling a duty ratio or a duty cycle of pulse width modulation (PWM)), limiting smoking, determining whether a cigarette (or a cartridge) is inserted, and displaying a notification. For example, the controller 460 may control generation of an aerosol on the basis of the sensing result by a puff sensor.

For example, the at least one sensor 430 may include a puff sensor. The puff sensor may detect a user's puff based on any one of a temperature change, a flow change, a voltage change, and a pressure change.

In addition, the at least one sensor 430 may include a temperature sensor. The temperature sensor may detect a temperature at which the heater 420 (or an aerosol generating material) is heated. The aerosol generating device 400 may include a separate temperature sensor for sensing a temperature of the heater 420, or the heater 420 itself may serve as a temperature sensor instead of including a separate temperature sensor. Alternatively, a separate temperature sensor may be further included in the aerosol generating device 400 while the heater 420 serves as a temperature sensor.

In addition, the at least one sensor 430 may include a position change detecting sensor. The position change detecting sensor may detect a change in a position of the slider coupled to the main body to move with respect to the main body.

The user interface 440 may provide the user with information about the state of the aerosol generating device 400. The user interface 440 may include various interfaces, such as a display or a light emitter for outputting visual information, a motor for outputting haptic information, a speaker for outputting audio information, input/output (I/O) interface (for example, a button or a touch screen) for receiving information input from the user or outputting information to the user, terminals for performing data communication or receiving charging power, and a communication interface for performing wireless communication (for example, Wi-Fi, Wi-Fi direct, Bluetooth, near-field communication (NFC), etc.) with external devices.

However, the aerosol generating device 400 may be implemented by selecting only some of the above-described various interfaces.

The memory 450 may be a hardware component configured to store various pieces of data processed in the aerosol generating device 400, and the memory 450 may store data processed or to be processed by the controller 460. The memory 450 may include various types of memories, such as random access memory, such as dynamic random access memory (DRAM), static random access memory (SRAM), etc., read-only memory (ROM), electrically erasable programmable read-only memory (EEPROM), etc.

The memory 450 may store an operation time of the aerosol generating device 400, the maximum number of puffs, the current number of puffs, at least one temperature profile, at least one power supply profile, data on a user's smoking pattern, etc.

The controller 460 is a hardware component configured to control overall operations of the aerosol generating device 400. The controller 460 may include at least one processor. A processor can be implemented as an array of a plurality of logic gates or can be implemented as a combination of a microprocessor and a memory in which a program executable by the microprocessor is stored. It will be understood by one of ordinary skill in the art that the processor can be implemented in other forms of hardware.

The controller 460 may be configured to analyze the sensing result by the at least one sensor 430, and control respective operations thereof.

The controller 460 may control power supplied to the heater 420 so that the operation of the heater 420 is started or terminated, based on the sensing result by the at least one sensor 430. In addition, based on the sensing result by the at least one sensor 430, the controller 460 may control the amount of power supplied to the heater 420 and the time at which the power is supplied, so that the heater 420 is heated to a predetermined temperature or maintained at an appropriate temperature.

The controller 460 may control the user interface 440 based on the sensing result by the at least one sensor 430. For example, based on counting the number of puffs using the puff sensor, when the number of puffs reaches a preset value, the controller 460 may notify the user that the aerosol generating device 400 will end soon, by using at least one of a lamp, a motor, and a speaker.

Although not illustrated in FIG. 5, the aerosol generating device 400 and a separate cradle may constitute an aerosol generating system. For example, the cradle may be used to charge the battery 410 of the aerosol generating device 400. For example, the aerosol generating device 400 may be supplied with power from a battery of the cradle to charge the battery 410 of the aerosol generating device 400 while being accommodated in an accommodation space of the cradle.

Figure 6:
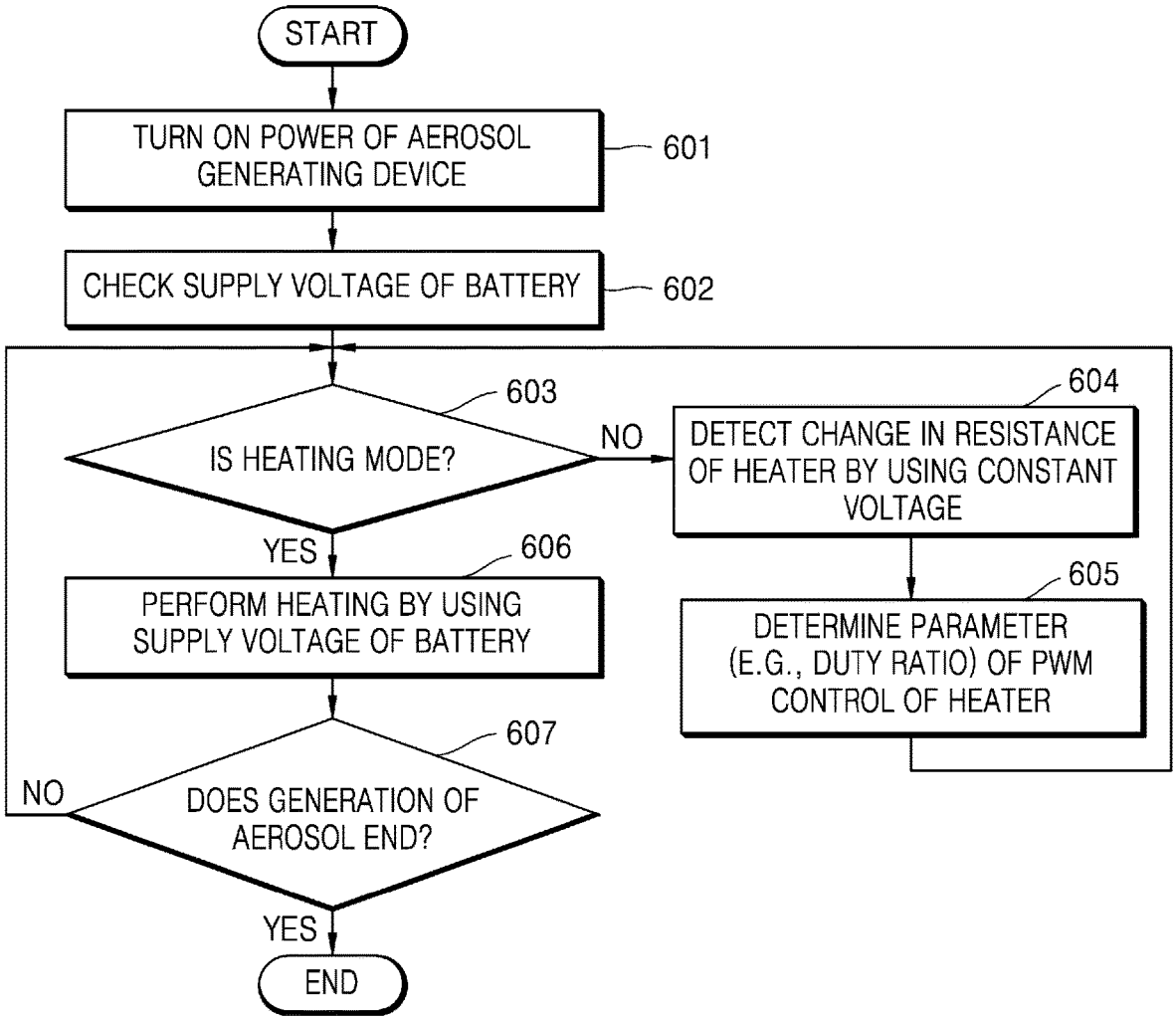
FIG. 6 is a flowchart of a method of controlling a heater for generating an aerosol in an aerosol generating device, according to an exemplary embodiment.

FIG. 6 is a flowchart of a method of controlling a heater for generating an aerosol in an aerosol generating device according to an exemplary embodiment.

Referring to FIG. 6, a method of controlling a heater in the aerosol generating device 400 includes operations that are processed in time series in the aerosol generating device 400 described above. Although some of the descriptions of the aerosol generating device 400 described above are omitted below, the descriptions of the aerosol generating device 400 may be applied to the method of FIG. 6.

In operation 601, the aerosol generating device 400 enters a power-on state to start generation of an aerosol. The aerosol generating device 400 may be switched on to the power-on state by a user manipulating the slider 7 of FIG. 1 or may be switched on to the power-on state by detecting a user's puff through the puff sensor. In addition, when the aerosol generating device 400 includes a separate switch, button, or the like, the aerosol generating device 400 may be switched to the power-on state by the user manipulating the switch, button, or the like or may be switched to the power-on state by various types of elements supported by the aerosol generating device 400.

In operation 602, the controller 460 of the aerosol generating device 400 checks a supply voltage of the battery 410. Here, the controller 460 may check the level of a supply voltage and supply power from the battery 410 on the basis of a remaining life of the battery 410.

The controller 460 may check the supply voltage to determine a duty ratio for pulse width modulation (PWM) control of the heater 420. For example, when the checked supply voltage is 4.3V, the controller 460 may determine a PWM duty ratio as 88% to apply a battery supply voltage of 3.8V to the heater 420. However, when the remaining life of the battery 410 is lowered and the checked supply voltage is 3.8V, the controller 460 may determine the PWM duty ratio as 100% to apply the battery supply voltage of 3.8V to the heater 420.

In operation 603, the controller 460 determines whether a current operation mode is a heating mode or a monitoring mode. When the current operation mode is determined as the heating mode, operation 606 is performed. When the current operation mode is determined as the monitoring mode, operation 604 is performed.

The heating mode is a mode for performing heating of the heater 420 by the supply voltage of the battery 410, and the monitoring mode is a mode for performing detection of a change in resistance of the heater 420 by a constant voltage which is DC/DC converted from the supply voltage of the battery 410. The controller 460 may be configured to switch between the operation modes so that the monitoring mode and the heating mode may be performed alternately and repeatedly.

The controller 460 may classify and determine an operation mode using a constant voltage (i.e., the monitoring mode) and an operation mode not using a constant voltage (i.e., the heating mode). When the aerosol generating device 400 controls operations such as heating of the heater 420 and monitoring of temperature/resistance of the heater 420, by using only a constant voltage of a predetermined level (e.g., 3.3V), which is DC/DC converted from the supply voltage (e.g., 4.3V) of the battery 410, a voltage difference between the supply voltage of the battery 410 and the constant voltage (i.e., 1V) may not be used, and thus, the supply voltage of the battery 410 (e.g., 4.3V) may not be efficiently used. Therefore, the controller 460 may control a constant voltage to be applied for an operation that needs precise and accurate power control and control the supply voltage of the battery 410 to be unchangeably applied to an operation that does not need precise and accurate power control, thereby improving efficiency of the battery 410.

When the current operation mode is determined as the monitoring mode, in operation 604, the controller 460 detects a change in resistance of the heater 420 by using the constant voltage of the predetermined level. Here, the constant voltage of the predetermined level may be 3.3V but is not limited thereto, and may be a voltage value of another level.

The controller 460 may detect the change in resistance of the heater 420 by sensing a current flowing through a resistance element after applying the constant voltage to the resistance element connected in series or parallel to the heater 420.

In operation 605, the controller 460 determines a parameter (e.g., a duty ratio, a duty cycle, a heating time, or the like) of PWM control of the heater 420 on the basis of the detected change in resistance. In other words, based on the change in resistance of the heater 420 being detected in a current monitoring mode, the controller 460 may determine a duty ratio or a duty cycle of PWM control in a next heating mode.

When a resistance value of the heater 420 is detected as increasing, a temperature of the heater 420 may be determined as also increasing. When the resistance value of the heater 420 is detected as decreasing, the temperature of the heater 420 may be determined as also decreasing. Accordingly, the controller 460 performs PWM control to reduce the duty ratio or the duty cycle in the next heating mode when the resistance value of the heater 420 becomes greater than a predetermined resistance value in the current monitoring mode and performs PWM control to increase the duty ratio or the duty cycle in the next heating mode when the resistance value of the heater 420 becomes less than the predetermined resistance value in the current monitoring mode, thereby controlling a heating temperature of the heater 420 within a preset target temperature range.

When operation 605 is completed, the controller 460 performs operation 603 again. Here, the controller 460 may determine a current operation mode as a heating mode so that a next heating mode is performed on the basis of a duty ratio or a duty cycle of PWM control that is determined through the monitoring mode.

When the current operation mode is determined as the heating mode, in operation 606, the controller 460 controls the heater 420 to heat an aerosol generating material by using a supply voltage provided from the battery 410. Here, based on a feedback of monitoring according to a change in resistance detected through the application of a constant voltage in the monitoring mode, the controller 460 may perform PWM control of a supply voltage to be provided to the heater 420.

In operation 607, the controller 460 determines whether to end the generation of an aerosol. For example, based on determining that a predetermined number of puffs is performed by a user, a predetermined time elapses from a power-on state, or a user input of a power-off command being received, or the like, the controller 460 may determine to end the generation of the aerosol, i.e., switching to a power-off state. When the generation of the aerosol is determined to end, the method ends. However, when the generation of the aerosol is determined to be continued (e.g., when a number of possible puffs remains or a predetermined time period has not elapsed), the method returns to operation 603.

When operation 603 is performed again, the controller 460 may determine the current operation mode as the monitoring mode to detect a change in resistance of the heater 420 in the heating mode.

In other words, until the generation of the aerosol ends, the controller 460 controls the heater 420 for generating an aerosol by controlling switching of the monitoring mode for performing detection of the change in resistance by a constant voltage and the heating mode for performing heating of the heater 420 by a supply voltage of the battery 410.

Figure 7:
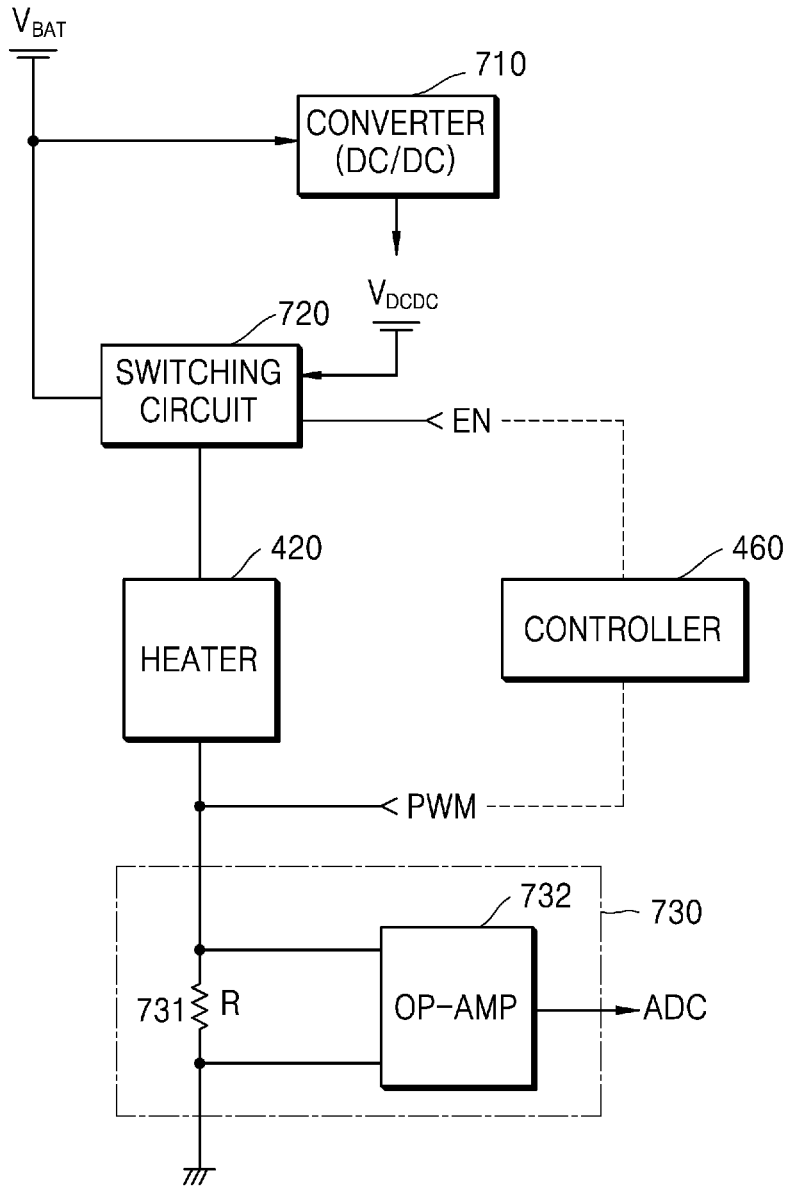
FIG. 7 is a view illustrating a circuit configuration of an aerosol generating device according to an exemplary embodiment.

FIG. 7 is a view illustrating a circuit configuration of an aerosol generating device, according to an exemplary embodiment. The circuit configuration of FIG. 7 corresponds to a circuit configuration inside the aerosol generating device 400 of FIG. 5.

Referring to FIG. 7, a converter 710 (i.e., direct current/direct current (DC/DC)) is configured to convert a supply voltage $V_{BAT}$ provided from the battery 410 of FIG. 5 into a constant voltage $V_{DCDC}$ of a predetermined level, and output the constant voltage $V_{DCDC}$.

A switching circuit 720 performs switching so that one of the supply voltage $V_{BAT}$ of the battery 410 and the constant voltage $V_{DCDC}$ is selectively provided to a circuit. Specifically, switching of the switching circuit 720 between the supply voltage $V_{BAT}$ and the constant voltage $V_{DCDC}$ may be controlled by an enable signal EN provided from a controller 460. When a current operation mode is a heating mode, the controller 460 may transmit, to the switching circuit 720, the enable signal EN for applying the supply voltage $V_{BAT}$ of the battery 410 to a heater 420. Alternatively, when the current operation mode is a monitoring mode, the controller 460 may transmit, to the switching circuit 720, the enable signal EN for applying the constant voltage $V_{DCDC}$ to a detection circuit 730. In other words, the controller 460 may control one of the monitoring mode and the heating mode to be selectively performed by controlling the switching circuit 720.

The heater 420 may be configured to heat an aerosol generating material by using the supply voltage $V_{BAT}$ provided from the battery 410 to generate an aerosol from the aerosol generating material in the heating mode. The controller 460 performs PWM control of the supply voltage $V_{BAT}$ to be provided to the heater 420 for the heating mode. Here, the controller 460 may perform PWM control of the supply voltage $V_{BAT}$ to be provided to the heater 420 by performing feedback of monitoring using a change in resistance detected through application of the constant voltage $V_{DCDC}$ in a previous monitoring mode.

The switching circuit 720 may be connected to one end of the heater 420, and the detection circuit 730 may be connected to the other end of the heater 420.

The detection circuit 730 is a circuit including a resistance element R 731 and an operational amplifier OP-AMP 732. When the current operation mode is the monitoring mode, the constant voltage $V_{DCDC}$ is applied to the resistance element R 731 of the detection circuit 730 connected in series to the heater 420. Therefore, the detection circuit 730 may detect a change in resistance of the heater 420 by sensing a current flowing through the resistance element R 731. Further, the detection circuit 730 amplifies, through the operational amplifier OP-AMP 732, a current value flowing through the resistance element R 731, performs analog-to-digital convert (ADC) with respect to the amplified current value, and outputs a digital value, which is acquired from the ADC, to the controller 460. The controller 460 may detect a change in resistance of the heater 420 by calculating a resistance value of the heater 420 on the basis of a result of current sensing received from the detection circuit 730.

A correlation between the resistance value of the heater 420 and a temperature of the heater 420 may be predefined and stored as a lookup table (LUT) in the memory 450 of FIG. 5. Accordingly, based on the lookup table (LUT), the controller 460 may estimate a current temperature of the heater 420 by acquiring a temperature value mapped to a resistance value of the heater 420 detected by the detection circuit 730 in the monitoring mode.

Figure 8:
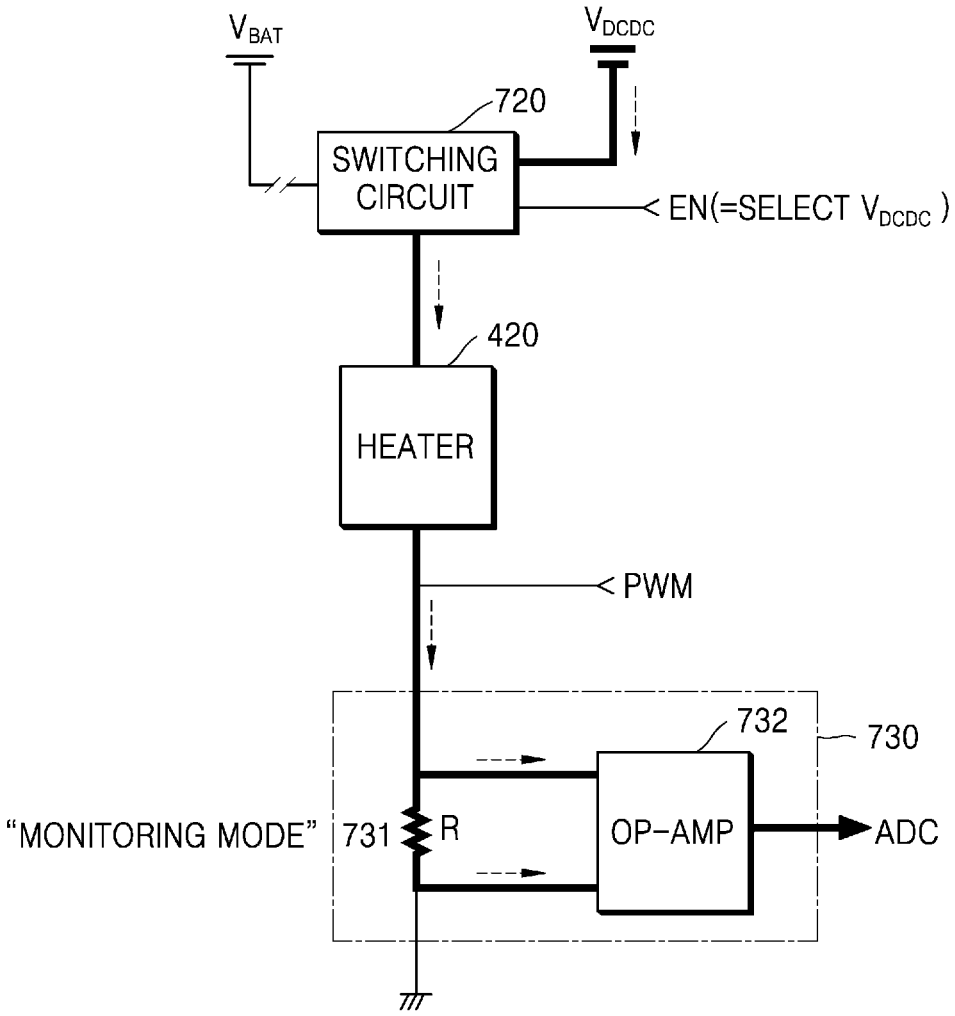
FIG. 8 is a view illustrating operations of circuit components of an aerosol generating device in a monitoring mode according to an exemplary embodiment.

FIG. 8 is a view illustrating operations of circuit components of an aerosol generating device in a monitoring mode, according to an exemplary embodiment.

Referring to FIG. 8, the controller 460 of FIG. 7 generates an enable signal EN for applying a constant voltage $V_{DCDC}$ to a switching circuit, according to a monitoring mode. A switching circuit 720 switches application of the constant voltage $V_{DCDC}$ according to the enable signal EN.

The current sensing is performed by applying the provided constant voltage $V_{DCDC}$ to a resistance element R 731 of a detection circuit 730, and an operational amplifier OP-AMP 732 of the detection circuit amplifies a current value sensed by the resistance element R 731 and outputs the amplified current value to the controller 460.

On the basis of a resistance value of the resistance element R 731 sensed by the constant voltage $V_{DCDC}$ applied according to the monitoring mode, the controller 460 may detect a change in resistance of a heater 420 connected to the resistance element R 731.

Figure 9:
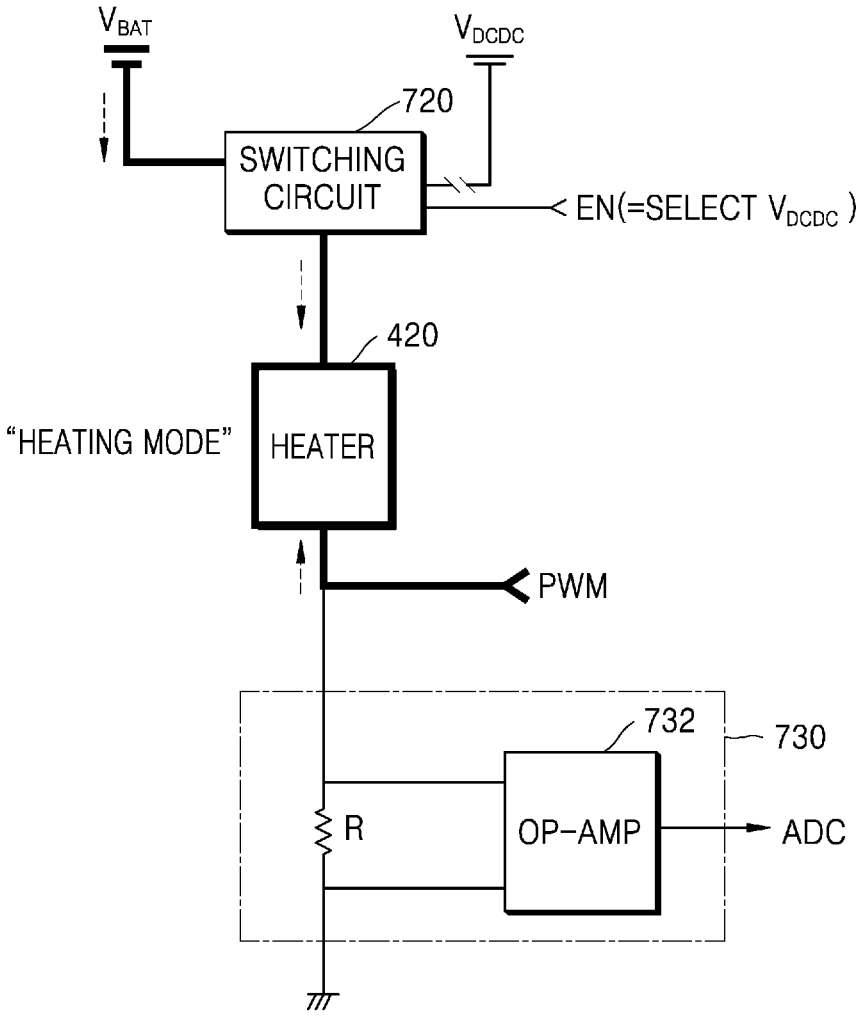
FIG. 9 is a view illustrating operations of circuit components of an aerosol generating device in a heating mode according to an exemplary embodiment.

FIG. 9 is a view illustrating operations of circuit components of an aerosol generating device in a heating mode, according to an exemplary embodiment.

Referring to FIG. 9, the controller 460 (shown in FIG. 7) generates an enable signal EN for applying a supply voltage $V_{BAT}$ of the battery 410 (shown in FIG. 5) to a switching circuit, according to a heating mode. A switching circuit 720 switches application of the supply voltage $V_{BAT}$ according to the enable signal EN.

A heater 420 may be configured to heat an aerosol generating material by using the supply voltage $V_{BAT}$ to generate an aerosol from the aerosol generating material in a heating mode.

The controller 460 performs PWM control of the supply voltage $V_{BAT}$ to be provided to the heater 420 for the heating mode. Here, on the basis of feedback of a change in resistance detected through application of the constant voltage $V_{DCDC}$ in a monitoring mode, the controller 460 may determine a parameter (e.g., a duty ratio, a duty cycle, a heating time, or the like) of PWM control and perform PWM control of the supply voltage $V_{BAT}$ to be provided to the heater 420, according to the determined parameter of PWM control.

While an aerosol is generated in a power-on state of the aerosol generating device 400 (shown in FIG. 5), the controller 460 controls switching so that the monitoring mode of FIG. 8 and the heating mode of FIG. 9 are performed alternately and repeatedly. A change in resistance of the heater 420 detected by using the constant voltage $V_{DCDC}$ in the monitoring mode is fed back to the controller 460, and, in the heating mode, the controller 460 performs, on the basis of a result of the feedback, PWM control of the supply voltage $V_{BAT}$ provided to the heater 420 to control an aerosol generating material to be heated within a target temperature range.

Figure 10:
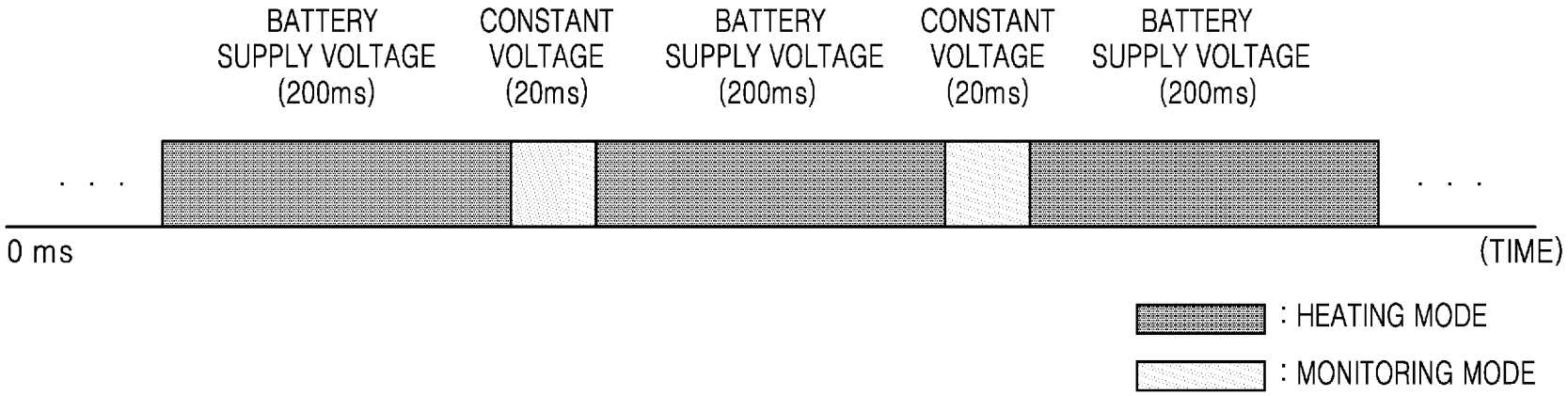
FIG. 10 is a view illustrating repeated switching between a monitoring mode and a heating mode while an aerosol generating device generates an aerosol according to an exemplary embodiment.

FIG. 10 is a view illustrating repetitive switching between a monitoring mode and a heating mode while an aerosol generating device generates an aerosol according to an exemplary embodiment.

Referring to FIG. 10, when a generation of an aerosol starts in a power-on slate of the aerosol generating device 400 (shown in FIG. 5), the controller 460 (shown in FIG. 5) may be configured to repeatedly switch between a monitoring mode and a heating mode.

Under the control of the controller 460, the heater 420 (shown in FIG. 5) may be heated by the supply voltage $V_{BAT}$ during a period of the heating mode (e.g., 200 ms), and a change in resistance of the heater 420 is detected by the constant voltage $V_{DCDC}$ during a period of the monitoring mode (e.g., 20 ms) thereafter. On the basis of the detected change in resistance of the heater 420, the controller 460 determines a parameter (e.g., a duty ratio or the like) for PWM control in a next heating mode. Under the control of the controller 460, the heater 420 is reheated by the supply voltage $V_{BAT}$ during a period of the next heating mode (e.g., 200 ms), and a change in resistance of the heater 420 is detected by the constant voltage $V_{DCDC}$ during a period of a next monitoring mode (e.g., 20 ms). Through such a process of repeating feedback by monitoring and heating control according to the feedback, when a temperature of the heater 420 may be maintained within a target temperature range, an aerosol generating material may be heated, thereby increasing a smoking satisfaction of a user. The process described above may be repeated until the generation of an aerosol ends in the aerosol generating device 400. However, numerical values such a voltage and a time described with reference to the drawings are only examples and are not limited thereto, and various other numerical values may be applied.

Figure 11:
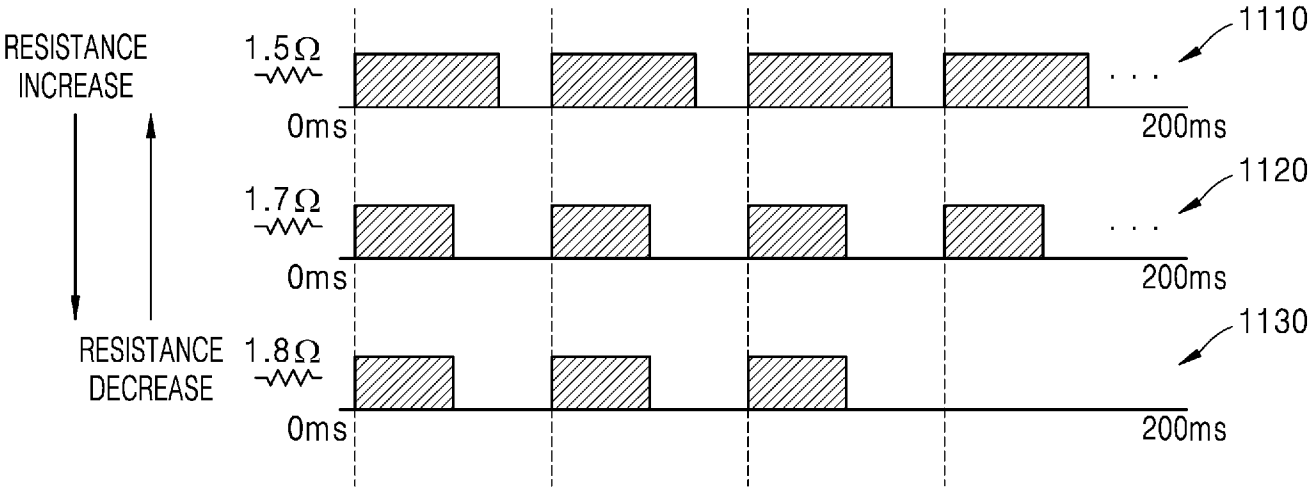
FIG. 11 is a view illustrating a change in a parameter of pulse width modulation (PWM) control in a heating mode on the basis of a change in resistance of a heater detected in a monitoring mode according to an exemplary embodiment.

FIG. 11 is a view illustrating a change in a parameter of PWM control in a heating mode on the basis of a change in resistance of heater detected in a monitoring mode according to an exemplary embodiment.

FIG. 11 illustrates a PWM duty ratio in a case 1110 where a resistance of the heater 420 of FIG. 5 is 1.5Ω, a PWM duty ratio in a case 1120 where a resistance of the heater 420 is 1.7Ω, and a PWM duty ratio in a case 1130 where a resistance of the heater 420 is 1.8Ω.

For example, referring to FIG. 11. a reference resistance of the heater 420 for maintaining a target temperature range is described as 1.7Ω. However, this is only an example, and the embodiments are not limited thereto.

When the resistance of the heater 420 is detected as decreasing from 1.7Ω to 1.5Ω in a monitoring mode, the controller 460 of FIG. 5 may control a PWM duty ratio to increase. In other words, the controller 460 may control to supply more supply voltage $V_{BAT}$ to the heater 420.

When the resistance of the heater 420 is detected as increasing from 1.7Ω to 1.8Ω in the monitoring mode, the controller 460 may control a PWM duty ratio to decrease or may control PWM control to be performed only for a shorter time. In other words, the controller 460 may control to supply less supply voltage $V_{BAT}$ to the heater 420.

As described above, on the basis of feedback of a change in resistance of the heater 420 detected in the monitoring mode, a parameter of PWM control to be performed in a heating mode may be determined so that the heater 420 may heat an aerosol generating material within a target temperature range.

The controller 460 may control a constant voltage $V_{DCDC}$ to be applied for a monitoring operation needing relatively precise and accurate power control and control a supply voltage $V_{BAT}$ of the battery 410 to be unchangeably applied for a heating operation that does not need relatively precise and accurate power control, thereby efficiently using a voltage of the battery 410.

Figure 12:
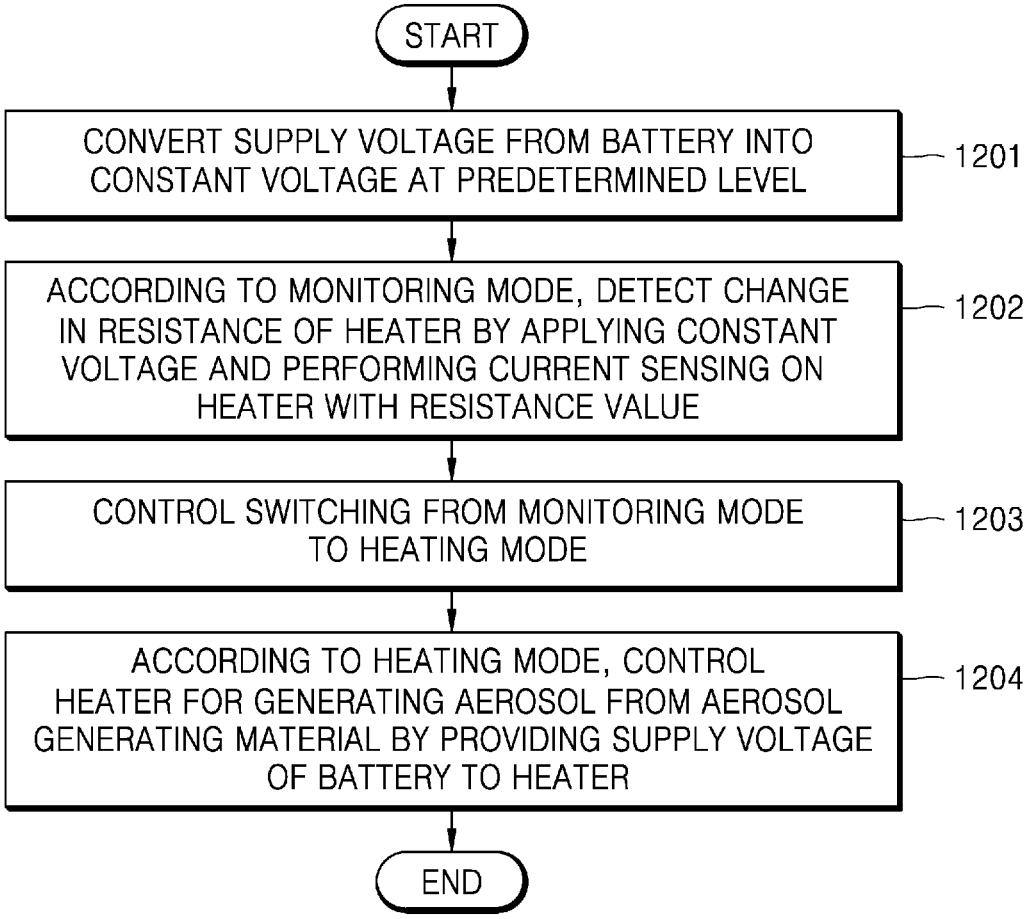
FIG. 12 is a flowchart of a method of controlling heating of a heater in an aerosol generating device according to an exemplary embodiment.

FIG. 12 is a flowchart of a method of controlling heating of a heater in an aerosol generating device, according to an exemplary embodiment.

Referring to FIG. 12, the method of controlling heating of a heater in the aerosol generating device 400 (shown in FIG. 5) includes operations that are processed in time series in the aerosol generating device 400 described above. Therefore, although the descriptions of the aerosol generating device 400 with reference to the drawings described above are omitted below, the descriptions may also be applied to the method of FIG. 12.

In operation 1201, the converter 710 of the aerosol generating device 400 may be configured to convert a supply voltage from the battery 410 into a constant voltage at a predetermined level (or a predetermined constant voltage).

In operation 1202, the detection circuit 703 detects a change in resistance of the heater 420 by applying the constant voltage and performing current sensing on the heater 420 with a predetermined resistance value, according to a monitoring mode.

In operation 1203, the controller 460 controls switching from the monitoring mode to a heating mode.

In operation 1204, the controller 460 controls the heater 420 to generate an aerosol from an aerosol generating material by providing the supply voltage of the battery 410 to the heater 420, according to the heating mode.

At least one of the components, elements, modules or units (collectively "components" in this paragraph) represented by a block in the drawings, such as the controller 460 in FIG. 5 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The above-described method may be written as a program executable in a computer and may be implemented in a computer that operates the program by using a computer-readable recording medium. In addition, a structure of data used in the above-described method may be recorded on a non-transitory computer-readable recording medium via various types of elements. The computer-readable recording medium includes storage media such as a magnetic storage medium (e.g., ROM, RAM, a USB, a floppy disk, a hard disk, or the like) and optical reading medium (e.g., CD-ROM, DVD, or the like).

Those of ordinary skill in the art related to the present embodiments may understand that various changes in form and details can be made therein without departing from the scope of the disclosure. The one or more embodiments of the inventive concept should be considered in a descriptive sense only and not for the purpose of limiting the scope of the disclosure. The scope of the disclosure should be defined by the appended claims, and any modifications, substitutions, improvements and equivalents thereof should be construed as falling within the scope of the disclosure and protection defined in the claims.

The invention claimed is:

1. An aerosol generating device comprising:

a battery configured to supply power for generating an aerosol from an aerosol generating material;

a converter configured to convert a supply voltage from the battery into a constant voltage of a predetermined level;

a heater configured to heat the aerosol generating material using the supply voltage;

a switching circuit configured to perform a switching so that one of the constant voltage and the supply voltage is selectively supplied to the heater;

a detection circuit configured to detect a change in resistance of the heater by applying the constant voltage output from the converter and performing a current sensing on the heater with a resistance value; and a controller configured to control the heater for generating the aerosol by controlling the switching circuit to selectively perform one of a monitoring mode for performing the detection of the change in the resistance of the heater using the constant voltage and a heating mode for heating the heater using the supply voltage, wherein based on a change in a temperature of the heater corresponding to the change in the resistance of the heater detected by applying the constant voltage in a current monitoring mode, the controller is further configured to determine a duty ratio or a duty cycle for a pulse width modulation (PWM) control on the power to be supplied to the heater for a subsequent heating mode so that the aerosol generating material is heated to a target temperature range in the subsequent heating mode.

2. The aerosol generating device of claim 1, wherein the controller is further configured to:

perform the PWM control so that the duty ratio or the duty cycle decreases in the subsequent heating mode based on the resistance value of the heater being greater than a predetermined resistance value in the current monitoring mode, and perform the PWM control so that the duty ratio or the duty cycle increases in the subsequent heating mode based on the resistance value of the heater being less than the predetermined resistance value in the monitoring mode.

3. The aerosol generating device of claim 1, wherein the controller is further configured to control the switching so that the monitoring mode and the heating mode are performed alternately and repeatedly.

4. The aerosol generating device of claim 1, wherein the constant voltage of the predetermined level is 3.3V.

5. The aerosol generating device of claim 1, further comprising:

a cartridge having a liquid reservoir including the aerosol generating material in a liquid state, wherein the cartridge comprises:

a wick through which the aerosol generating material is transferred; and the heater wound around the wick.

6. A method of controlling an aerosol generating device, the method comprising:

converting a supply voltage from a battery into a constant voltage of a predetermined level;

controlling a switching circuit to perform a switching between a monitoring mode and a heating mode so that one of the constant voltage and the supply voltage is selectively supplied to a heater;

detecting, in the monitoring mode, a change in resistance of the heater by applying the constant voltage and performing a current sensing on the heater with a resistance value;

controlling the switching from the monitoring mode to the heating mode; and based on switching to the heating mode, controlling heating of the heater for generating an aerosol from an aerosol generating material by supplying the supply voltage of the battery to the heater, wherein the controlling the heating comprises, based on a change in a temperature of the heater corresponding to the change in the resistance of the heater detected by applying the constant voltage in a current monitoring mode, determining a duty ratio or a duty cycle for a pulse width modulation (PWM) control on a power to be supplied to the heater for a subsequent heating mode so that the aerosol generating material is heated to a target temperature range in the subsequent heating mode.

7. The method of claim 6, wherein the determining of the duty ratio or the duty cycle comprises:

based on the resistance value of the heater being greater than a predetermined resistance value in the current monitoring mode, determining the duty ratio or the duty cycle to decrease in the subsequent heating mode; and based on the resistance value of the heater being less than the predetermined resistance value in the current monitoring mode, determining the duty ratio or the duty cycle to increase in the subsequent heating mode.

8. The method of claim 6, further comprising:

based on the controlling of the heating being performed during a predetermined period, controlling the switching from the heating mode to the monitoring mode, wherein the monitoring mode and the heating mode are switched to be performed alternately and repeatedly.

* * * * *